US005326076A

United States Patent [19]

Sorensen et al.

[11] Patent Number: 5,326,076

[45] Date of Patent: Jul. 5, 1994

[54] HAND CREW CLAMP

[75] Inventors: Joseph A. Sorensen, Lincoln; Toby J. Beckmann, Seward, both of Nebr.

[73] Assignee: Petersen Manufacturing Co. Inc., Dewitt, Nebr.

[21] Appl. No.: 73,097

[22] Filed: Jun. 7, 1993

[51] Int. Cl.[5] ..... B25B 1/02

[52] U.S. Cl. ..... 269/182; 269/219; 269/221

[58] Field of Search ..... 269/181, 182, 218, 219, 269/220, 221

[56] References Cited

U.S. PATENT DOCUMENTS

| | | | |
|---|---|---|---|
| 86,534 | 2/1869 | Hall | |
| 3,745 | 11/1869 | Schmidt | 269/219 |
| 169,027 | 10/1875 | Naumann | 269/182 |
| 174,838 | 3/1876 | Naumann | 269/182 |
| 178,022 | 5/1876 | Naumann | 269/182 |
| 179,942 | 7/1876 | Naumann | 269/182 |
| 266,887 | 10/1882 | Reno | 269/219 |
| 305,989 | 9/1884 | Weiser | |
| 368,278 | 8/1887 | Cheney | 269/221 |
| 658,574 | 9/1900 | McDonnell . | |
| 742,647 | 10/1903 | Herriman . | |
| 754,063 | 3/1904 | Hawkins . | |
| 823,166 | 6/1906 | Glover . | |
| 825,151 | 7/1906 | McLean . | |
| 996,244 | 6/1911 | Hess . | |
| 1,021,110 | 3/1912 | Niewohner . | |
| 1,042,610 | 3/1912 | Schulz . | |
| 1,429,050 | 9/1922 | Sylvester | 269/219 |
| 1,716,887 | 6/1929 | Griesell . | |
| 1,740,238 | 11/1929 | Gustafson . | |
| 2,066,541 | 1/1937 | Schenk . | |
| 2,133,892 | 10/1938 | Gelinski . | |
| 3,220,721 | 11/1965 | Wahli et al. | 269/182 |

FOREIGN PATENT DOCUMENTS

| | | |
|---|---|---|
| 150587 | 1/1991 | Taiwan . |
| 153978 | 3/1991 | Taiwan . |

OTHER PUBLICATIONS

Photographs of "Drill Press Vise with Threaded Rod and Spring Biased Quarter Nut."

*Primary Examiner*—Robert C. Watson

*Attorney, Agent, or Firm*—Willian Brinks Hofer Gilson & Lione

[57] ABSTRACT

A hand screw clamp includes first and second jaws and a pair of threaded rods, each having a handle for manual rotation. Two first couplers are mounted to the first jaw and coupled to the threaded rods, and two releasable couplers are mounted to the second jaw and coupled to the threaded rods. The releasable couplers each include a threaded portion engageable with the threaded rods and a slidable portion sized to accommodate sliding movement of the threaded rods. A push plate is movably mounted to the second jaw and engaged with both of the releasable couplers. This push plate is movable between a first position, in which both of the threaded portions are engaged with the rods and manual rotation of the handles moves the second jaw along the threaded rods, and a second position, in which both of the threaded portions are disengaged from the threaded rods and the threaded rods are free to slide past the slidable portions without rotation of the threaded rods.

10 Claims, 3 Drawing Sheets

HAND CREW CLAMP

BACKGROUND OF THE INVENTION

This invention relates to a hand screw clamp that can be moved quickly into clamping position without rotating the threaded rods of the hand screw.

Hand screw clamps have long been a preferred clamp for cabinet makers and other wood workers. Conventionally, such clamps include two jaws which are interconnected by two threaded rods. Threaded couplers are provided on each of the rods, rotatably mounted in each of the jaws. Typically, each threaded rod has two threaded portions which are threaded in opposite senses, and the threaded rods can be manually rotated to adjust the tilt angle between the first and second jaws, and to clamp a work piece between the jaws.

Conventional hand screw clamps suffer from the disadvantage that they require extensive rotation of the threaded rods (or of the jaws around the threaded rods) to move the jaws from a fully opened to a fully closed position.

SUMMARY OF THE INVENTION

According to this invention, a hand screw clamp is provided comprising first and second jaws and a pair of threaded rods, each of the rods comprising a handle for manual rotation. Two first couplers are mounted to the first jaw and coupled to the threaded rods, and two releasable couplers are mounted to the second jaw and coupled to the threaded rods. The releasable couplers each comprise a threaded portion engageable with the respective threaded rod and a slidable portion sized to accommodate sliding movement of the respective threaded rod. An actuating element is movably mounted to the second jaw and coupled with both of the releasable couplers. The actuating element is movable between an engaged position, in which both of the threaded portions are engaged with the respective threaded rods and manual rotation of the handles moves the second jaw along the threaded rods, and a disengaged position, in which both of the threaded portions are disengaged from the respective threaded rods and the threaded rods are free to slide past the slidable portions without rotation of the threaded rods.

DETAILED DESCRIPTION OF THE PRESENTLY PREFERRED EMBODIMENTS

Figure 1:
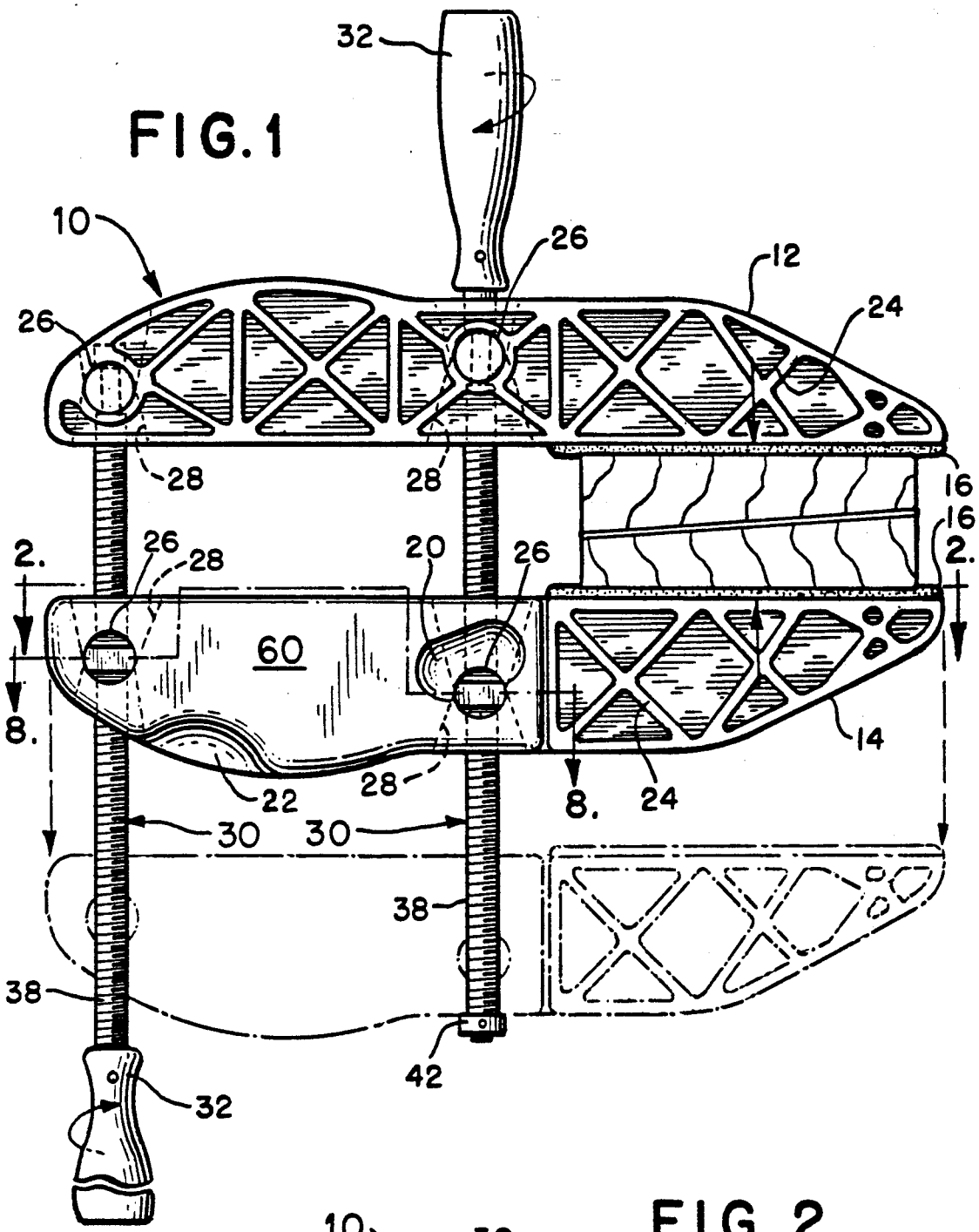
FIG. 1 is a front view of a hand screw clamp which incorporates a preferred embodiment of this invention, showing the jaws clamping a workpiece with parallel sides.
Figure 2:
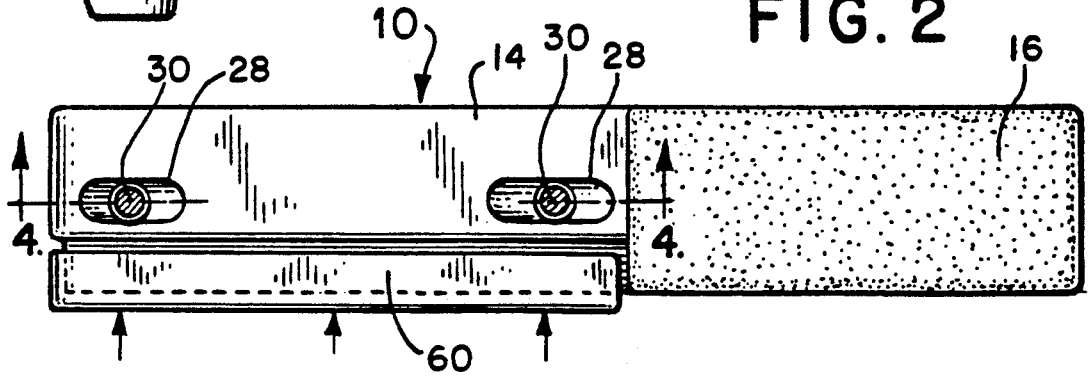
FIG. 2 is a sectional view taken along line 2—2 of FIG. 1.
Figure 3:
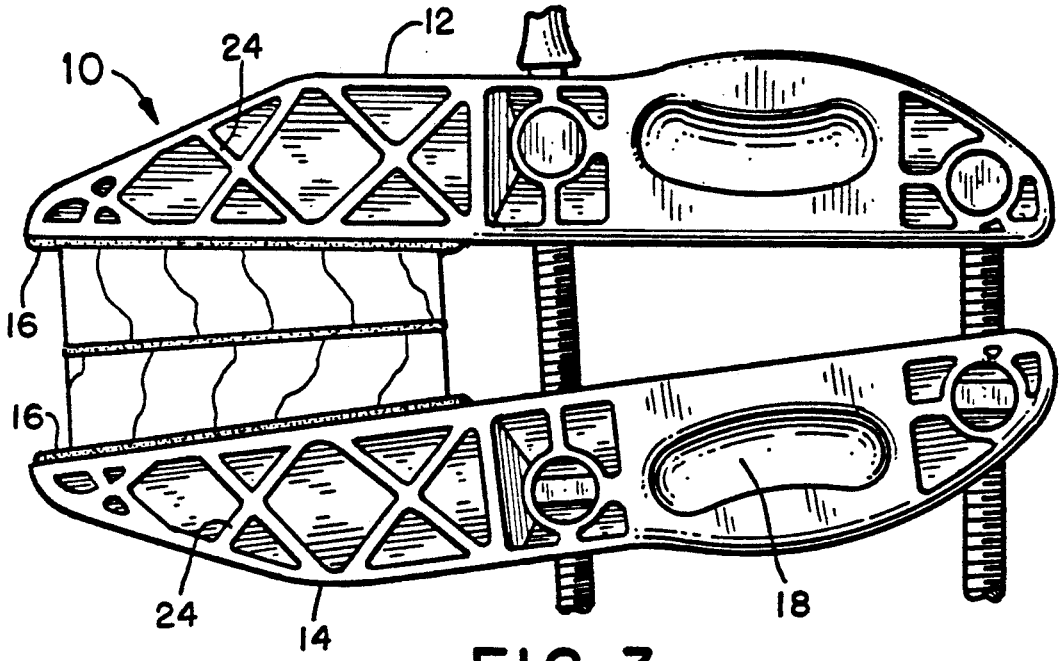
FIG. 3 is a rear view of the clamp of FIG. 1, showing the jaws clamping a workpiece with non-parallel sides.

Turning now to the drawings, FIGS. 1-3 show a hand screw clamp 10 which incorporates a presently preferred embodiment of this invention.

The hand screw clamp 10 includes first and second jaws 12, 14, each provided with an elastomeric clamping pad 16. The jaw 14 defines a finger depression 18 on one side (FIG. 3), and a thumb depression 20 and a hand depression 22 on the opposed side (FIG. 1). A user can readily grasp the jaw 14 by placing his fingers in the finger depression 18, his thumb in the thumb depression 20, and the heel of his hand in the hand depression 22.

In this embodiment the jaws 12, 14 are molded of a synthetic material such as glass reinforced nylon, and the jaws 12, 14 define strengthening cross webs 24. Of course, in alternative embodiments the jaws 12, 14 can be formed of wood or other suitable materials. The pads 16 may be formed of a material such as Santoprene, a trademark of Monsanto.

Figure 4:
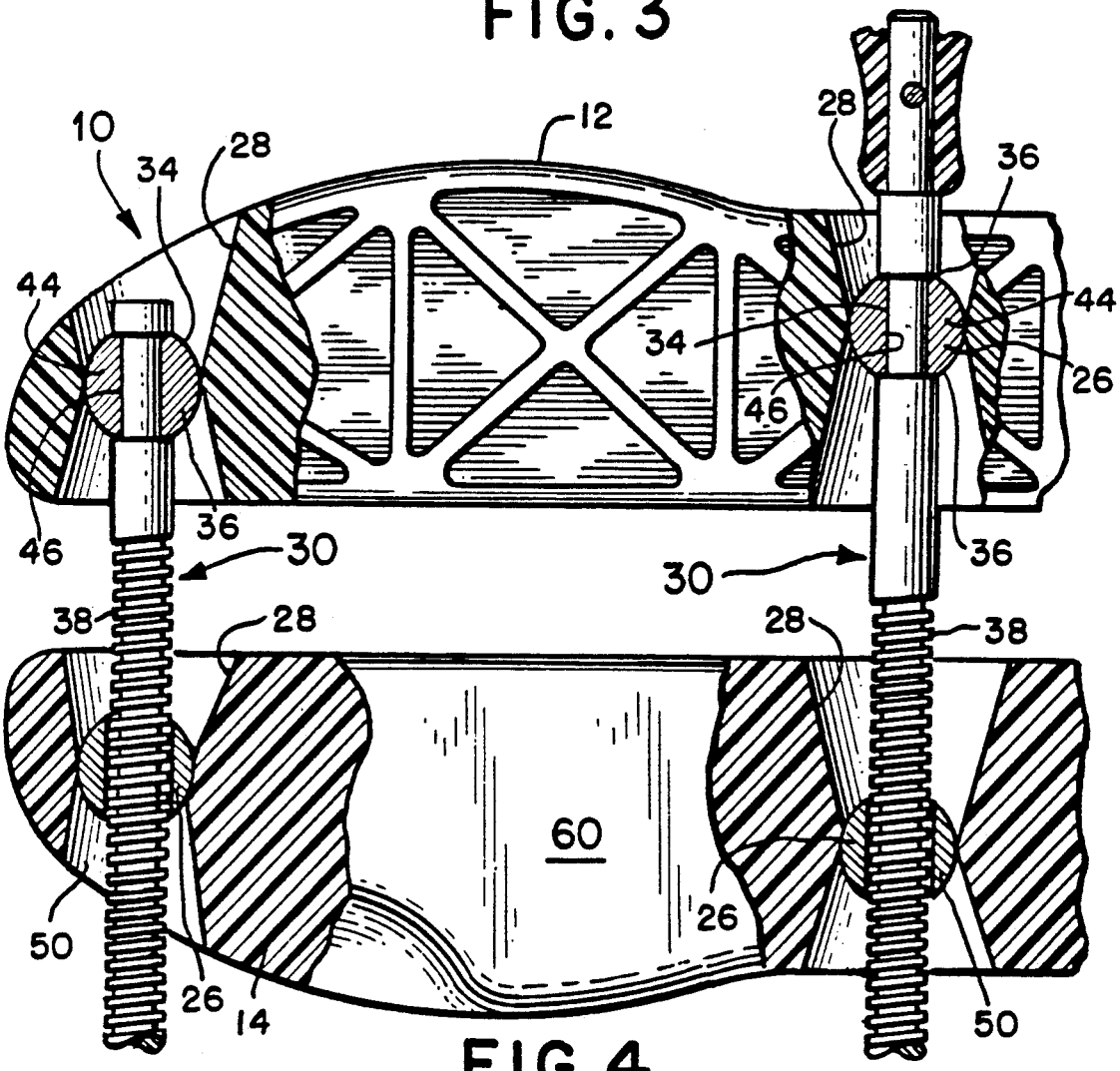
FIG. 4 is a partial sectional view taken along line 4—4 of FIG. 2.

The jaws 12, 14 each define two cylindrical recesses 26 which intersect slots 28 (FIGS. 1 and 4). The slots 28 are generally hourglass in shape for reasons explained below.

As shown in FIG. 1, the clamp 10 includes a pair of threaded rods 30, each having a handle 32 affixed to one end. Each of the threaded rods 30 defines a threaded portion 38 which extends along almost the entire length of the rod 30, threaded in a single sense. One of the threaded rods 30 defines a stop ring 42 at its free end. This threaded rod 30 defines an annular groove 34 situated between two flanges 36 at the end adjacent the respective handle 32 (FIG. 4). The other of the threaded rods 30 defines a similar groove 34 and flanges 36 at the free end of the threaded rod 30, opposite the respective handle 32 (FIG. 4). In this embodiment, the handles are formed of a synthetic material such as polypropylene or another suitable material such as wood.

Figure 5:
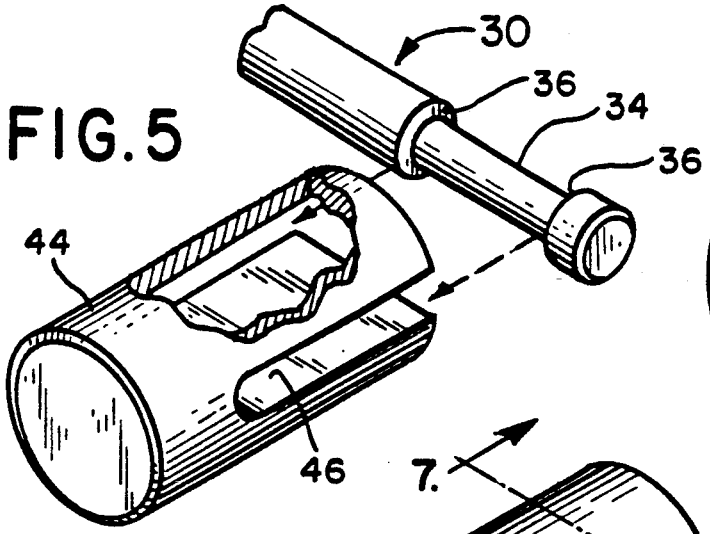
FIG. 5 is a perspective view of one of the first couplers of the clamp of FIG. 1.

A pair of first couplers 44 are positioned in the cylindrical recesses 26 of the first jaw 12. These first couplers 44 each define a slot 46 sized to receive a respective one of the threaded rods 30 with the first coupler 44 fitting into the groove 34, and the flanges 36 bearing on the first coupler 44 to prevent axial movement between the first couplers 44 and the threaded rods 30 (FIG. 5). The first couplers 44 are preferably mounted for rotation in the first jaw 12 while being restrained against axial movement out of the cylindrical recesses 26.

Figure 7:
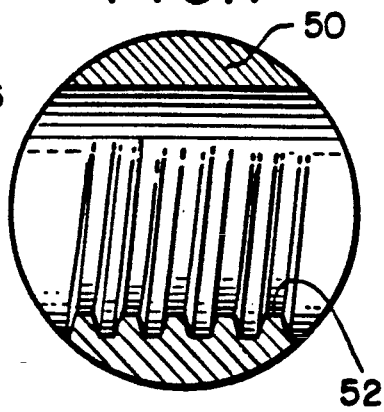
FIG. 7 is a sectional view taken along line 7—7 of FIG. 6.
Figure 6:
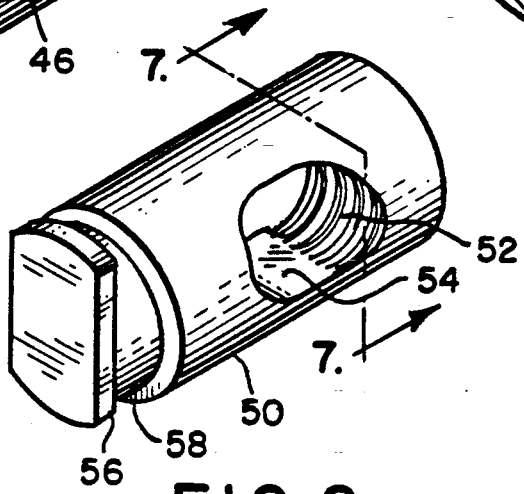
FIG. 6 is a perspective view of one of the releasable couplers of the clamp of FIG. 1.

A pair of releasable couplers 50 are rotatably mounted in the cylindrical recesses 26 of the second jaw 14. As shown in FIGS. 6 and 7, each of the these releasable couplers 50 includes a threaded portion 52 and an enlarged slidable portion 54. In this embodiment, the threaded portions 52 engage between a quarter and a third of the circumference of the threaded rod 30 and can therefore be described as quarter nuts. Each of the releasable couplers 50 defines an outer flange 56 and an adjacent groove 58.

Figure 8:
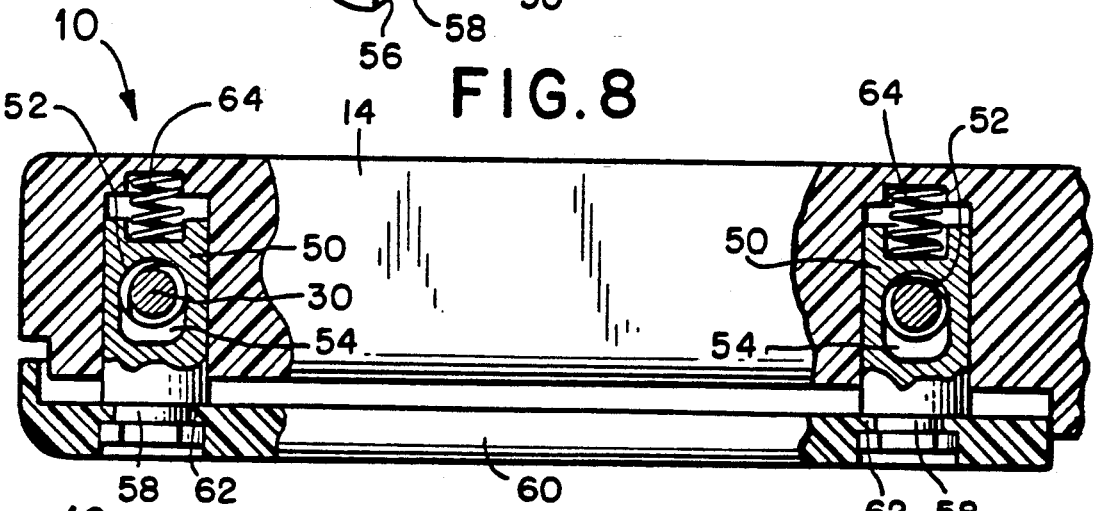
FIG. 8 is a sectional view taken along line 8—8 of FIG. 1 showing the releasable couplers engaged with the two threaded rods.
Figure 9:
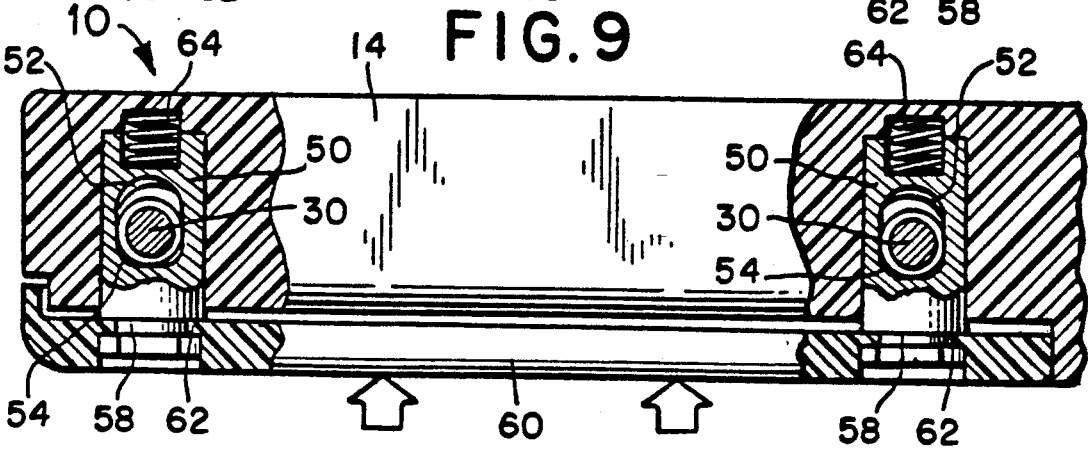
FIG. 9 is a sectional view corresponding to FIG. 8 showing the releasable couplers disengaged from the threaded rods.

As shown in FIGS. 8 and 9, a push plate 60 defines a pair of openings and associated flanges 62 which fit into the grooves 58 of the releasable couplers 50. Compression coil springs 64 are mounted in recesses in the second jaw 14 to bear on the releasable couplers 50 and to resiliently bias the releasable couplers 50 and the push plate 60 to the extended or engaged position shown in FIG. 8. Manual pressure on the push plate 60 (exerted for example by a user closing his hand with his fingers in the finger depression and his thumb and hand in the thumb and hand depressions) overcomes this resilient biasing force to move the push plate 60 and the releasable couplers 50 to the depressed or disengaged position shown in FIG. 9. In this embodiment, the couplers 44, 50 and the rods 30 are formed of heat treated carbon steel and the push plate is formed of a suitable synthetic material such as polypropylene. Alternative embodiments can use other materials such as high strength plastics for the couplers 44, 50 and the rods 30.

As best shown in FIG. 9, the releasable couplers 50 are oriented with the deeper part of the threaded portions 52 to the outside. This allows the threaded portions 52 to threadedly engage the threaded rods 30 in a reliable way when the threaded rods 30 are rotated to apply clamping pressure between the jaws 12, 14.

When a user releases the push plate 60 and rotates the threaded rods 30, the hand screw clamp 10 operates like a conventional hand screw clamp. Selective rotation of the threaded rods 30 allows a clamping force to be developed between the jaws 12, 14, while also allowing the tilt angle between the jaws 12, 14 to be adjusted. The hourglass shape of the slots 28 (FIG. 1) accommodates a range of tilt angles between the jaws 12, 14. In this mode of operation, the push plate 60 and the releasable couplers 50 are in the engaged position shown in FIG. 8, and the threaded portions 52 threadedly engage the threaded rods 30.

When a user desires to open or close the gap between the jaws 12, 14 by a larger amount, he simply depresses the push plate 60 to the position shown in FIG. 9. In this position, the releasable couplers 50 are moved such that the threaded portions 52 are no longer threadedly engaged with the threaded rods 30, and the threaded rods 30 are free to slide through the slidable portions 54, without rotation of the threaded rods 30.

In this mode of operation, the user can quickly make large scale adjustments to the position of the second jaw 14 with respect to the first jaw 12 by simply sliding the second jaw 14 along the stationary threaded rods 30. When these large scale adjustments are completed, the user simply releases the push plate 60, and the push plate 60 and the releasable couplers 50 are returned to the engaged position of FIG. 8 by the springs 64.

Note that the push plate 60 is oriented parallel to a plane passing through the threaded rods 30, and the push plate 60 is therefore easily operated by the user. In the engaged position of FIG. 8, the push plate 60 is farther from the threaded rods 30 than in the disengaged position of FIG. 9. This means that a simple squeezing action of the user can move the push plate 60 and the releasable couplers 50 to the disengaged position, and that the normal position of the push plate 60 and the releasable couplers 50 is the engaged position of FIG. 8.

From the foregoing, it will be apparent that the push plate 60 operates as a means for allowing a user to move both of the releasable couplers 50 simultaneously to the disengaged position of FIG. 8 with one hand. This allows convenient, reliable and simple operation of the clamp 10. The flanges 62 of the push plate 60 are engaged with the releasable couplers 50, and these flanges 62 operate as means for causing the releasable couplers 50 to move in response to movement of the push plate 60. It will be appreciated that these functions can be performed by other structures. For example, in one alternative the releasable couplers 50 may be designed to release from the threaded rods 30 when tilted rather than axially moved. In this embodiment, a user would tilt or rotate the second jaw 14 from its normal position in order to disengage the releasable couplers 50 from the threaded rods 30 and allow large scale movement of the second jaw 14 without rotation of the threaded rods 30. In another alternative, an actuating element such as a control button or switch can be provided, and the means for causing the releasable couplers to move in response to movement of this actuating element can include an active control system such as electrically powered solenoids or a spring powered mechanism.

Of course, it should be understood that a wide range of changes and modifications can be made to the preferred embodiments described above. For example, the first couplers 44 can be threaded rather than slotted to threadedly engage the threaded rods 30, and the first couplers 44 can be made releasable if desired. In this case the threaded rods can be provided with two threaded regions that are threaded in opposite senses. The releasable couplers 50 can include quarter nuts as shown, or they can alternately be formed of other types of releasing threaded couplers which shift or tilt to release the coupler from the threaded rod. The springs 64 can be positioned to operate between the push plate 60 and the jaw 14, and they can be embodied as other types of springs, including torsion springs, extension springs and the like.

It is therefore intended that the foregoing detailed description be regarded as illustrative rather than limiting, and that it be understood that it is the following claims, including all equivalents, which are intended to define the scope of this invention.

We claim:

1. A hand screw clamp comprising:

first and second jaws;

a pair of threaded rods, each comprising a handle for manual rotation;

a pair of first couplers mounted to the first jaw and coupled to the threaded rods;

a pair of releasable couplers mounted to the second jaw and coupled to the threaded rods, said releasable couplers each comprising a threaded portion engageable with the respective threaded rod and a slidable portion sized to accommodate sliding movement of the respective threaded rod; and an actuating element movably mounted to the second jaw and engaged with both of the releasable couplers, said actuating element positioned adjacent the second jaw and movable along a direction substantially transverse to a plane passing through the threaded rods, said actuating element movable between an engaged position, in which both of the threaded portions are engaged with the respective threaded rods and manual rotation of the handles moves the second jaw along the threaded rods, and a disengaged position, in which both of the threaded portions are disengaged from the respective threaded rods and the threaded rods are free to slide past the slidable portions without rotation of the threaded rods.

2. The invention of claim 1 further comprising at least one spring engaged with the actuating element and the releasable couplers to bias the actuating element to the engaged position.

3. A hand screw clamp comprising:

first and second jaws;

a pair of threaded rods, each comprising a handle for manual rotation;

a pair of first couplers mounted to the first jaw and coupled to the threaded rods;

a pair of releasable couplers mounted to the second jaw and coupled to the threaded rods, said releasable couplers each comprising a threaded portion engageable with the respective threaded rod and a slidable portion sized to accommodate sliding movement of the respective threaded rod; and an actuating element movably mounted to the second jaw and engaged with both of the releasable couplers, said actuating element movable between an engaged position, in which both of the threaded portions are engaged with the respective threaded rods and manual rotation of the handles moves the second jaw along the threaded rods, and a disengaged position, in which both of the threaded portions are disengaged from the respective threaded rods and the threaded rods are free to slide past the slidable portions without rotation of the threaded rods;

wherein the actuating element comprises a push plate positioned alongside the second jaw generally parallel to a plane passing through the threaded rods.

4. The invention of claim 3 wherein the actuating element is farther from the threaded rods in the engaged position than in the disengaged position.

5. The invention of claim 1 wherein each of the releasable couplers comprises a respective quarter nut.

6. The invention of claim 1 further comprising a plurality of springs, each mounted between the second jaw and a respective one of the releasable couplers to bias the threaded portions into engagement with the respective threaded rods.

7. The invention of claim 1 wherein each of the first couplers comprises a slot that rotatably receives and axially holds the respective threaded rod in the first jaw.

8. A hand screw clamp comprising:

first and second jaws;

a pair of threaded rods, each comprising a handle for manual rotation;

a pair of first couplers mounted to the first jaw and coupled to the threaded rods;

a pair of releasable couplers mounted to the second jaw and coupled to the threaded rods, said releasable couplers each comprising a threaded portion engageable with the respective threaded rod and a slidable portion sized to accommodate sliding movement of the respective threaded rod; and means for allowing a user to simultaneously move both of the releasable couplers with one hand, said means comprising an actuating element movably mounted to the second jaw to move along a direction substantially transverse to a plane passing through the threaded rods, and means for causing the releasable couplers to move in response to movement of the actuating element, said actuating element operable to move the releasable couplers between an engaged position, in which both of the threaded portions are engaged with the respective threaded rods and manual rotation of the handles moves the second jaw along the threaded rods, and a disengaged position, in which both of the threaded portions are disengaged from the respective threaded rods and the threaded rods are free to slide past the respective slidable portions without rotation of the threaded rods.

9. A hand screw clamp comprising first and second jaws;

a pair of threaded rods, each comprising a handle for manual rotation and a protrusion near one end;

a pair of first couplers mounted to the first jaw and bearing on the protrusions to limit axial movement of the threaded rods while allowing rotation of the threaded rods with respect to the first jaw;

a pair of releasable couplers mounted to the second jaw and receiving the threaded rods, each of said releasable couplers comprising a threaded portion engageable with the respective threaded rod and a slidable portion sized to accommodate sliding movement of the respective threaded rod; and a push plate movably mounted to the second jaw and coupled to both of the releasable couplers, said push plate extending alongside the second jaw generally parallel to the threaded rods, said push plate movable between an extended position in which the threaded portions are engaged with the respective threaded rods and manual rotation of the handles moves the second jaw along the threaded rods, and a retracted position, in which the threaded portions are disengaged from the respective threaded rods and the threaded rods are free to slide past the slidable portions without rotation of the threaded rods to allow rapid movement of the second jaw relative to the first jaw; and at least one spring mounted to react against the second jaw to resiliently bias the push plate to the extended position.

10. The invention of claim 9 wherein the releasable couplers are rotatably mounted on the push plate, and wherein the at least one spring comprises two springs, each mounted between the second jaw and a respective one of the releasable couplers.

* * * * *

UNITED STATES PATENT AND TRADEMARK OFFICE

CERTIFICATE OF CORRECTION

PATENT NO. : 5,326,076

DATED : July 5, 1994

INVENTOR(S) : Joseph A. Sorensen et al.

It is certified that error appears in the above-indentified patent and that said Letters Patent is hereby corrected as shown below:

On the title page, and Col. 1, line 1

In the Title

In each occurrence of the title delete "CREW" and substitute --SCREW--.

Signed and Sealed this

Seventeenth Day of October, 1995

Bruce Lehman

*Attest:*

BRUCE LEHMAN

*Attesting Officer*

*Commissioner of Patents and Trademarks*